US005432399A

United States Patent [19]

Nagasawa et al.

[11] Patent Number: 5,432,399

[45] Date of Patent: Jul. 11, 1995

[54] DISCHARGE LAMP APPARATUS

[75] Inventors: Masakazu Nagasawa; Yukio Wakimizu; Masami Handa; Kunimasa Motiduki, all of Shizuoka, Japan

[73] Assignee: Koito Manufacturing Co., Ltd., Tokyo, Japan

[21] Appl. No.: 327,826

[22] Filed: Oct. 21, 1994

Related U.S. Application Data

[63] Continuation of Ser. No. 955,271, Oct. 1, 1992, abandoned.

[30] Foreign Application Priority Data

Oct. 14, 1991 [JP] Japan ..... 3-264799

[51] Int. Cl.[6] ..... H01J 5/50

[52] U.S. Cl. ..... 313/25; 313/318.08; 313/112; 362/293; 439/607

[58] Field of Search ..... 313/25, 318, 51, 112, 313/623, 626, 634, 331; 362/255, 293, 263; 439/237, 604, 617, 619

[56] References Cited

U.S. PATENT DOCUMENTS 5,032,758 7/1991 Davenport et al. ..... 313/318 X
5,059,855 10/1991 Irisawa et al. ..... 313/318
5,126,619 6/1992 Wakimizu et al. ..... 313/25
5,220,235 6/1993 Wakimizu et al. ..... 313/25
5,250,872 10/1993 Wakimizu et al. ..... 313/25
5,253,153 10/1993 Mathews et al. ..... 313/25 X

*Primary Examiner*—Sandra L. O'Shea
*Assistant Examiner*—Ashok Patel
*Attorney, Agent, or Firm*—Sughrue, Mion, Zinn, Macpeak & Seas

[57] ABSTRACT

A discharge lamp apparatus in which an insulating base for supporting a lead support base end portion maintains its dielectric strength over long periods of use, and which is simple to assemble. A lead support acting as a current path is projectingly provided on a front surface of a synthetic-resin insulating base, which is a lamp holder, a front end portion of an arc tube, which is a discharge lamp body, is supported by the lead support, a rear end portion of the arc tube is fixedly supported in an engagement concave portion formed in the insulating base, and the lead support is covered with a ceramic insulating cylindrical body. In accordance with the invention, a base end portion of the insulating cylindrical body is integrated with the insulating base through insert molding.

24 Claims, 3 Drawing Sheets

DISCHARGE LAMP APPARATUS

This is a Continuation of application Ser. No. 07/955,271 filed Oct. 1, 1992, now abandoned.

BACKGROUND OF THE INVENTION

The present invention relates to a discharge lamp apparatus, and particularly relates to a discharge lamp apparatus in which an arc tube, in the form of a discharge lamp body having opposed discharge electrodes received in an enclosed glass bulb, is supported by a lead support projecting from an insulating base made of synthetic resin.

As shown in FIG. 4, a discharge lamp apparatus of the same general type to which the invention relates includes a pair of metal lead supports 2 and 3, which act as current paths, projecting from an insulating base 1 made of synthetic resin, and an arc tube 4, which is a discharge lamp body, supported by the lead supports 2 and 3. The arc tube 4 has a sealed glass bulb 4*a* in which electrodes 5 are provided in opposition to each other. Lead wires 6*a* and 6*b* are electrically connected to the respective electrodes 5, and are connected to metal supports 7*a* and 7*b*, which are fixed to the respective lead supports 2 and 3. The lead supports 2 and 3 are respectively integrally welded to metal connector terminals 8*a* and 8*b* projecting outward from the rear side of the base 1. The lead support 2, which is integrated with the terminal 8*a* and insert-molded in the base 1, is coated with a covering portion 1*a* projecting from the base 1. The covering portion 1*a* is further covered with an insulating cylindrical body 9 made of ceramic, thereby ensuring good insulation properties from the terminal 8*b* side current path constituted by the lead support 3, the metal support 7*b*, and the lead wire 6*b*.

Reference numeral 9*a* designates a push-on type stopper for fixing the insulating cylindrical body 9 to the lead support 2. Reference numeral 1*b* designates a flange-like focusing ring formed on the base 1. The electrodes 5 are arranged in predetermined positions with respect to the focusing ring 1*b*. Reference symbol G designates an ultraviolet-ray shielding globe for cutting from the rays emitted by the arc tube ultraviolet rays within wavelengths harmful to health.

However, the discharge lamp apparatus described above has a problem in that the temperature of the arc tube 4 becomes so high that the covering portion 1*a* formed on the outer circumference of the lead support 2 is affected by the heat to thereby change its quality such that the dielectric strength at the covering portion 1*a* is lowered. Thus, the service life of the covering portion 1*a* is not sufficiently long. In the case in which the electrode 5 is set at a position shifted toward the lead support 2*a*, as particularly indicated by reference numeral 5*a* in FIG. 4, the quality of the covering portion 1*a* is even more strongly affected.

Further, in the conventional discharge lamp apparatus, the insulating cylindrical body 9 is fitted onto the lead support 2 and fixed by use of the push-on stopper 9*a* or the like so that the cylindrical body 9 cannot come off the lead support 2. This makes the assembling process of the discharge lamp apparatus troublesome.

SUMMARY OF THE INVENTION

The present invention has been attained in view of the foregoing problems in the prior art, and an object thereof is to provide a discharge lamp apparatus in which the dielectric strength of an insulating base for supporting a lead support base end portion does not deteriorate, even after the insulating base has been used for a long time. It is a further object of the invention to provide a discharge lamp which is simple to assemble.

In order to attain the above and other objects, according to the present invention, in a discharge lamp apparatus in which a lead support acting as a current path projects from the front surface of a synthetic-resin insulating base, which is a lamp holder, a front end portion of an arc tube, which is a discharge lamp body, is supported by the lead support, a rear end portion of the arc tube is fixedly supported in an engagement concave portion formed in the insulating base, the lead support is covered with a ceramic insulating cylindrical body, and a base end portion of the insulating cylindrical body is integrated with the insulating base through insert molding.

Further, in a discharge lamp apparatus in which a pair of long and short lead supports acting as current paths project from a front surface of a synthetic-resin insulating base, which is a lamp holder, front and rear end portions of an arc tube, which is a discharge lamp body, are supported by the pair of lead supports, the long lead support is covered with a ceramic insulating cylindrical body, and a base end portion of the insulating cylindrical body is integrated with the insulating base through insert molding.

The ceramic insulating cylindrical body, which is resistant to heat so that the quality thereof is hardly changed even by the high temperatures generated by the arc tube, is directly applied to cover the lead support. Accordingly, even after the discharge lamp apparatus has been used for a long time, the dielectric strength of the insulating base in the vicinity of the lead support is never lowered.

Further, a structure in which the insulating cylindrical body covering the lead support was previously integrally fixed on the lead support through an adhesive agent, a push-on stopper, or the like is integrated with the insulating base through insert molding. Accordingly, it is possible to omit an assembly step, which was essential in the conventional structure, in which the lead support is provided on the insulating base so as to project therefrom, and then the insulating cylindrical body is placed over the lead support and fixed through a push-on stopper or the like.

DESCRIPTION OF THE PREFERRED EMBODIMENTS

Figure 1:
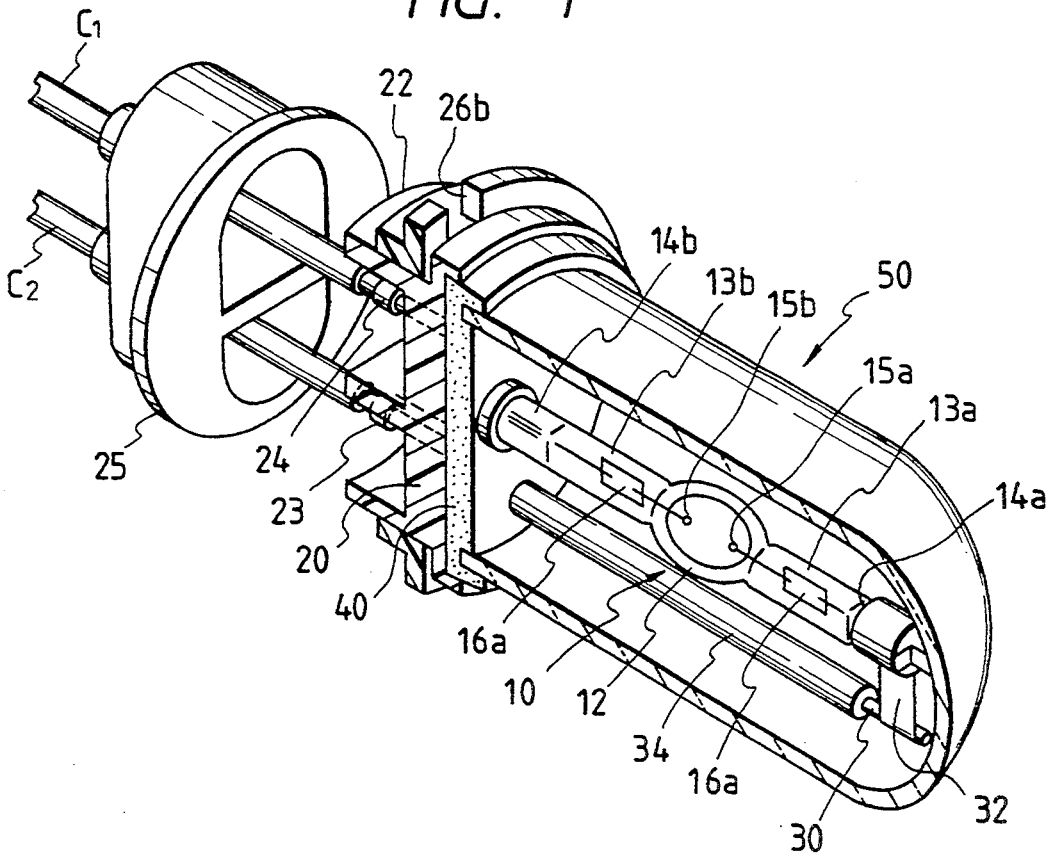
FIG. 1 is a partially broken perspective view of a discharge lamp apparatus constructed in accordance with a preferred embodiment of the present invention.

Referring to the drawings, preferred embodiments of the present invention will be described hereunder.

Figure 2:
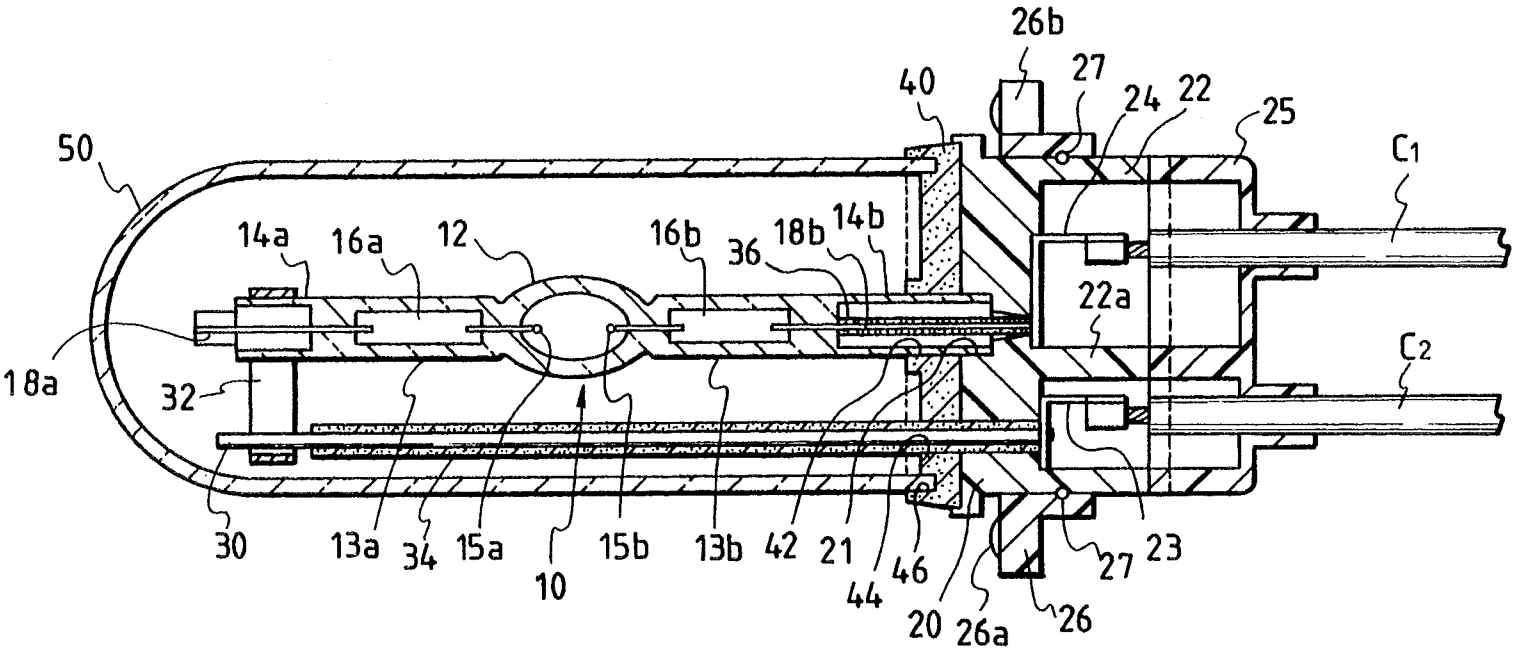
FIG. 2 is a vertical section of the discharge lamp apparatus of FIG. 1.

FIGS. 1 and 2 show a first embodiment of the present invention, of which FIG. 1 is a partially broken perspective view of a discharge lamp apparatus and FIG. 2 is a vertical section of the discharge lamp apparatus.

In the drawings, the discharge lamp apparatus is constituted mainly by an arc tube 10, which is a discharge lamp body, a synthetic-resin insulating base 20, which is a lamp holder, a metal lead support 30 which is provided on the base 20 so as to project therefrom and which acts as a current path and at the same time supports a front end portion of the arc tube, an engagement (cup-shaped) portion 21 which is formed in the base 20 at its front surface for supporting a rear end portion of the arc tube 10, and an ultraviolet-ray shielding globe 50 which is fixed on the front surface of the base 20 so as to enclose the arc tube 10 and the lead support 30.

The arc tube 10 has a structure in which pinch seal portions 13*a* and 13*b* rectangular in section are formed at opposite end portions of an oval enclosed glass bulb 12, and not-pinch-sealed cylindrical extension portions 14*a* and 14*b* are integrated with the pinch seal portions 13*a* and 13*b*, respectively.

A starting rare gas, mercury and a metal halide are sealed in the glass bulb 12. Tungsten discharge electrodes 15*a* and 15*b* are provided in opposition to each other in a discharge space in the enclosed glass bulb 12. The discharge electrodes 15*a* and 15*b* are connected to molybdenum foils 16*a* and 16*b* sealed in the pinch seal portions 13*a* and 13*b*, respectively, and lead wires 18*a* and 18*b* connected to the molybdenum foils 16*a* and 16*b*, respectively, lead out from the pinch seal portions 13*a* and 13*b* to the outside through the extension portions 14*a* and 14*b*, respectively. The extension portion 14*a* on the front end side is grasped by a metal band 32 spot-welded to the lead support 30, and the lead wire 18*a* is spot-welded to the metal band 32. The lead support 30 is plasma-welded to a connector terminal 23 provided on the rear side of the base 20. On the other hand, the extension portion 14*b* on the rear end side is engaged with the engagement portion 21 formed in the front surface of the base 20, and the lead wire 18*b* is plasma-welded to a connector terminal 24 fixed on the rear side of the insulating base 20 through insert molding. Thus, the arc tube 10 has a structure in which the front end portion of the arc tube 10 is supported by one metal lead support 30 projecting forward from the insulating base 20, and the rear end portion of the same is supported by the engagement portion 21 formed in the front surface of the base 20.

The insulating base 20 is made of a synthetic-resin material such as PPS or the like. The pair of connector terminals 23 and 24 are provided in a cylindrical wall 22 formed on the rear side of the insulating base 20 to thereby form a connector. A partition 22*a* crossing the cylindrical wall 20 is formed between the connector terminals 23 and 24 so as to ensure a good insulation effect between the terminals 23 and 24. Insulated high-voltage wires $C_1$ and $C_2$ extending from a lighting circuit (not shown) are connected to the connector terminals 24 and 23, respectively. A connector cover 25 is integrated with the connector cylindrical wall 22 by ultrasonic welding.

The lead support 30 extending forward from the insulating base 20 is covered with a cylindrical insulating body 34 made of ceramic so as to prevent discharge from occurring between the current path on the connector terminal 23 side and the current path on the connector terminal 24 side. The lead support 30 is previously inserted into the insulating cylindrical body 34, the lead support 30 and the insulating cylindrical body 34 are integrally fixed to each other through an inorganic bonding agent or a push-on stopper, the insulating cylindrical body 34 previously integrated with the lead support 30 is integrated with the insulating base 20 through insert molding, the rear end portion of the cylindrical body 34 penetrates the base 20 to its rear side, and the lead support 30 also penetrates the cylindrical body 34.

A ceramic disk 40 fixedly supporting the ultraviolet-ray shielding globe 50 is fixed to the front surface of the insulating base 20 through insert molding. That is, the ceramic disk 40 has the shape of a frustum of a circular cone, so that when the circumferential edge of the disk 40 at its rear surface side is insert molded to the base 20, the disk 40 performs an extraction preventing structure.

Holes 42 and 44 are formed in the ceramic disk 40, and the arc tube 10 and the insulating cylindrical body 34 penetrate the holes 42 and 44 respectively and extend forward. Reference numeral 36 designates a ceramic sleeve covering the lead wire 18*b* on the rear end side to ensure a good insulation effect between the lead wire 18*b* and the lead support 30.

The ultraviolet-ray shielding globe 50, which is a cylindrical glass transparent body closed at its top end and coated over its front and/or rear surface with an ultraviolet-ray shielding film such as ZnO or the like and which acts to cut off ultraviolet-rays in a harmful wavelength range, is fixedly bonded in a circular groove 46 of the ceramic disk 40 through an inorganic bonding agent, thereby to enclose the lead support 30 and the arc tube 10.

Reference numeral 26 designates an annular focusing ring provided on the circumferential edge portion of the base 20. A forward/rearward positioning protrusion 26*a*, which acts as a reference portion for positioning the bulb (discharge lamp apparatus) in the forward-/rearward direction (with respect to the optical axis) by abutting on the circumferential edge portion of a bulb insertion hole (not shown) of a reflector, is provided on the front surface of the focusing ring 26. A notch 26*b* engaged with an engagement convex portion on the bulb insertion hole side of the reflector so as to perform circumferential positioning of the bulb (discharge lamp apparatus) is formed in part of the outer circumferential edge of the focusing ring 26. A metal ring 27 is interposed between the abutting surfaces of the focusing ring 26 and the base 20. The metal ring 27 is heated by high-frequency induction heating so that the abutting surfaces of the focusing ring 26 and the insulating base 20 are fused and integrated with each other.

In this embodiment, the wire 18*b* on the rear end side is welded to the connector terminal 24, the lead wire 18*a* on the front end side is welded to the metal band 32, the metal band 32 is welded to the lead support 30, and the arc tube 10 is fixed to the base 20. Then, a current is caused to flow into the discharge lamp apparatus to make the arc tube 10 emit light. While the arc tube is emitting light, the focusing ring 26 is axially and circumferentially moved to effect adjustment so that the positional relationship between the focusing ring 26 and the electrodes 15*a* and 15*b* becomes suitable, thereby to perform alignment. Then, the focusing ring 26 is fixedly welded to the base 20.

Figure 4:
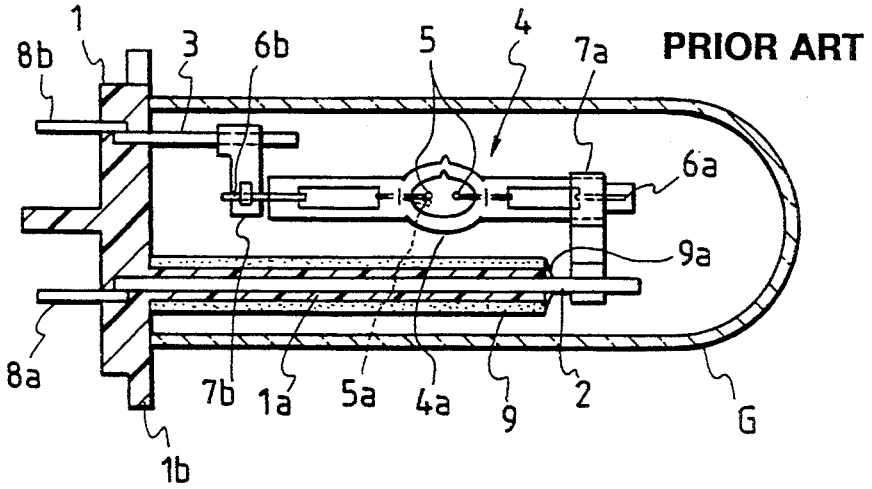
FIG. 4 is a vertical section of a conventional discharge lamp apparatus.

In the conventional discharge lamp apparatus where the focusing ring 1*a* is integrated with the base 1 as shown in FIG. 4, it is impossible to carry out alignment after the arc tube 4 is fixed to the focusing ring 1*a*. Accordingly, alignment must be performed by moving the metal supports 7*a* and 7*b* relative to the lead supports 2 and 3, respectively, or sliding the arc tube 4 circumferentially relative to the metal supports 7*a* and 7*b* to make the position of the electrodes proper relative to the focusing ring 1*a*. Thus, the aligning operation was extremely troublesome in the conventional apparatus. Further, since in the conventional apparatus the arc tube 4 had to be aligned in the unlit state because the arc tube 4 must be moved, the mercury sealed in the enclosed glass globe 4*a* tended to adhere to the electrodes 5 making the electrodes appear larger than their actual sizes, and thus making it impossible for the operator to clearly visually recognize the shapes and positions of the electrodes. Further, there was another problem in that metallic iodide also sealed in the enclosed glass bulb 4*a* adheres to the glass tube wall to further make visual recognition of the electrodes difficult.

According to this embodiment, on the contrary, the arc tube 10 can be aligned with the lamp in the lit state. Accordingly, any mercury adhering to the electrodes 15*a* and 15*b* and any metal iodide adhering to the glass tube wall is evaporated due to the high temperature, and the electrodes can be clearly visually recognized so that accurate alignment can be performed smoothly and accurately.

Figure 3:
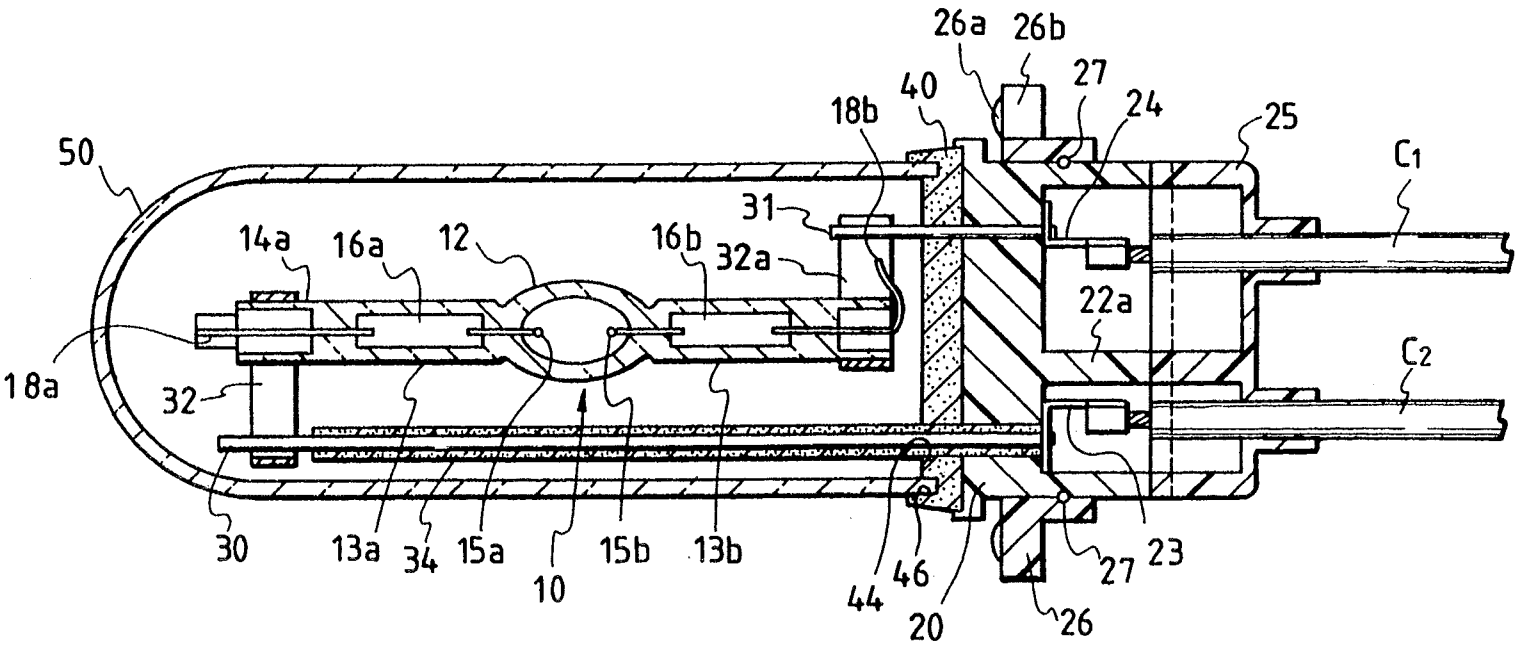
FIG. 3 is a vertical section of a discharge lamp apparatus constructed in accordance with another embodiment of the present invention.

FIG. 3 is a vertical section of a discharge lamp apparatus constructed according to a second embodiment of the present invention.

This embodiment has a structure in which two (long and short) lead supports 30 and 31 are provided on an insulating base 20 to project from its front surface, and opposite end portions of an arc tube 10 are supported by respective ones of the lead supports 30 and 31. Reference numeral 32*a* designates a metal band spot-welded to the lead support 31 for grasping the rear end portion of the arc tube 10. A rear-end-side lead wire 18*b* of the arc tube 10 is spot-welded to the metal band 32*a*. Further, the lead support 31 is plasma-welded to a connector terminal 24 provided on the rear side of the base. The other members are the same as those in the first-described embodiment and are therefore referenced correspondingly. A further description of such members will be omitted.

As is believed apparent from the above description, in the discharge lamp apparatus according to the present invention, a ceramic insulating cylindrical body, which is strongly resistant against heat so that it is hardly changed in quality even by the high temperature of the arc tube, directly covers the lead support. Accordingly, the discharge lamp apparatus according to the present invention is free from the disadvantage that the dielectric strength in the circumference of the lead support is lowered, thereby to lower the breakdown voltage, and the discharge lamp apparatus according to the present invention can be stably used for long periods of time while maintaining a constant dielectric strength.

Further, in a discharge lamp apparatus having a structure in which an insulating cylindrical body covering the lead support is integrated with an insulating base through insert molding, the insulating cylindrical body covering the lead support is previously integrally fixed to the lead support through an adhesive agent or a push-on stopper. Accordingly, an assembly step in which a lead support is projected from a base and then an insulating cylindrical body is provided and fixed on the lead support is unnecessary. Thus, the manufacturing process of the discharge lamp apparatus can be simplified with the invention.

What is claimed is:

1. A discharge lamp apparatus comprising: an insulating base formed of a synthetic resin; an arc tube having a rear end portion through which passes a first terminal, said rear end portion being fixedly supported in an engagement portion formed in said insulating base; a lead support; and a ceramic insulating cylindrical body covering said lead support, a front end portion of said lead support supporting a front end portion of said arc tube and providing a conductive path to a second terminal of said arc tube, said lead support projecting from a front surface of said insulating base, and said cylindrical body having a base end portion insert molded with said insulating base.

2. The discharge lamp apparatus of claim 1, further comprising a metal band welded to said front end portion of said lead support, said metal band having a portion grasping a first cylindrical extension portion of said arc tube at said front end portion of said arc tube and being welded to a first lead wire of said arc tube.

3. The discharge lamp apparatus of claim 2, further comprising first and second connector terminals provided on a rear side of said insulating base, a rear end portion of said lead support penetrating said insulating base and being welded to said first terminal, and said arc tube having a second lead wire passing through said insulating base and being welded to said second terminal.

4. The discharge lamp apparatus of claim 3, wherein said insulating base comprises a cylindrical wall formed on a rear side thereof and a partition crossing said cylindrical wall between said first and second connector terminals.

5. The discharge lamp apparatus of claim 3, further comprising a ceramic sleeve covering said second lead wire.

6. The discharge lamp apparatus of claim 1, further comprising a ceramic disk fixed to a front end surface of said insulating base.

7. The discharge lamp apparatus of claim 6, wherein said ceramic disk is fixed to said front surface of said insulating base by insert molding.

8. The discharge lamp apparatus of claim 6, wherein holes are formed in said ceramic disk through which pass said rear end portion of said arc tube and said lead support covered with said ceramic insulating cylindrical body.

9. The discharge lamp apparatus of claim 6, further comprising an ultraviolet-ray shielding globe having a rear portion fixedly bonded in a circular groove of said ceramic disk.

10. The discharge lamp apparatus of claim 1, further comprising an annular focusing ring provided on a circumferential edge portion of said insulating base.

11. The discharge lamp apparatus of claim 10, wherein an engaging notch is formed on an outer circumferential edge of said focusing ring, and wherein said focusing ring comprises a forward/rearward positioning protrusion formed on a front surface of said focusing ring.

12. The discharge lamp apparatus of claim 10, further comprising an annular metal ring positioned between said annular focusing ring and said insulating base for use in high-frequency induction welding said focusing ring to said insulating base.

13. A discharge lamp apparatus comprising: an insulating base formed of a synthetic resin; an arc tube; a short lead support and a long lead support projecting from a front surface of said insulating base, said short lead support supporting a rear end portion of said arc tube and providing a conductive path to a first terminal of said arc tube, said long lead support supporting a front end portion of said arc tube and providing a conductive path to a second terminal of said arc tube, said long lead support being covered with a ceramic insulating cylindrical body, and said cylindrical body having a base end portion insert molded with said insulating base.

14. The discharge lamp apparatus of claim 13, further comprising a first metal band welded to a front end portion of said long lead support, said first metal band having a portion grasping a first cylindrical extension portion of said arc tube at said front end portion of said arc tube and being welded to a first lead wire of said arc tube, and a second metal band welded to a front end portion of said short lead support, said second metal band having a portion grasping a second cylindrical extension portion of said arc tube at said rear end portion of said arc tube and being welded to a second lead wire of said arc tube.

15. The discharge lamp apparatus of claim 14, further comprising first and second connector terminals provided on a rear side of said insulating base, a rear end portion of said lead support penetrating said insulating base and being welded to said first terminal, and said arc tube having a second lead wire passing through said insulating base and being welded to said second terminal.

16. The discharge lamp apparatus of claim 15, wherein said insulating base comprises a cylindrical wall formed on a rear side thereof and a partition crossing said cylindrical wall between said first and second connector terminals.

17. The discharge lamp apparatus of claim 13, further comprising a ceramic disk fixed to a front end surface of said insulating base.

18. The discharge lamp apparatus of claim 17, wherein said ceramic disk is fixed to said front surface of said insulating base by insert molding.

19. The discharge lamp apparatus of claim 17, wherein holes are formed in said ceramic disk through which pass said short lead support and said long lead support covered with said ceramic insulating cylindrical body.

20. The discharge lamp apparatus of claim 17, further comprising an ultraviolet-ray shielding globe having a rear portion fixedly bonded in a circular groove of said ceramic disk.

21. The discharge lamp apparatus of claim 13, further comprising an annular focusing ring provided on a circumferential edge portion of said insulating base.

22. The discharge lamp apparatus of claim 21, wherein an engaging notch is formed on an outer circumferential edge of said focusing ring, and wherein said focusing ring comprises a forward/rearward positioning protrusion formed on a front surface of said focusing ring.

23. The discharge lamp apparatus of claim 21, further comprising an annular metal ring positioned between said annular focusing ring and said insulating base for use in high-frequency induction welding said focusing ring to said insulating base.

24. The discharge lamp apparatus of claim 21, wherein said engagement portion is cup-shaped.

* * * * *